United States Patent [19]

Thomsen

[11] Patent Number: 4,948,111

[45] Date of Patent: Aug. 14, 1990

[54] METHOD AND APPARATUS FOR INCORPORATING BACKING BOARDS IN THE PRINTED PAPER STACK OF A PRINTING PRESS

[76] Inventor: Elmer R. Thomsen, 1021 NE. 135th Ave., Portland, Oreg. 97230

[21] Appl. No.: 255,244

[22] Filed: Oct. 11, 1988

[51] Int. Cl.[5] ..... B65H 43/00

[52] U.S. Cl. ..... 270/59; 412/2; 414/789.5; 414/789.6; 270/58

[58] Field of Search ..... 270/54–59; 412/2, 8, 37; 271/9; 414/788.1, 789.4, 789.5, 789.6, 788

[56] References Cited

U.S. PATENT DOCUMENTS

| | | | |
|---|---|---|---|
| 3,979,112 | 9/1976 | Munn | 270/59 |
| 4,068,835 | 1/1978 | Bortner | 270/59 |
| 4,473,425 | 9/1984 | Baughman | 270/58 |
| 4,626,156 | 12/1986 | Baughman | 270/58 |
| 4,671,719 | 6/1987 | Pulskamp | 412/2 |

FOREIGN PATENT DOCUMENTS

| | | | |
|---|---|---|---|
| 6629 | 1/1980 | European Pat. Off. | 270/58 |
| 2800846 | 7/1979 | Fed. Rep. of Germany | 270/58 |
| 55-48150 | 4/1980 | Japan | 270/58 |

*Primary Examiner*—Robert E. Garrett
*Assistant Examiner*—Therese M. Newholm
*Attorney, Agent, or Firm*—Olson & Olson

[57] ABSTRACT

Backing boards are delivered one at a time from a supply hopper to a stack of printed paper sheets at the stacking station outfeed end of a printing press while the outfeed of the next succeeding printed sheet is delayed for a time sufficient to allow the backing board to be delivered onto the stack. In one embodiment, the delay is achieved by stopping delivery of a blank sheet to the printing station of the press. In another embodiment, the delay is achieved by extending an arm into the path of gravity fall of the printed paper sheet toward the stack. A plurality of groups of printed sheets, each provided with a backing board, thus may be assembled in the stack. If the stack is to be bonded together with adhesive at one edge, a cutting line is installed at each backing board to facilitate cutting the adhesive layer to form a plurality of pads. The board inserting apparatus is supported on a vertically adjustable housing to adapt it to various types and sizes of commercial printing presses.

31 Claims, 8 Drawing Sheets

METHOD AND APPARATUS FOR INCORPORATING BACKING BOARDS IN THE PRINTED PAPER STACK OF A PRINTING PRESS

BACKGROUND OF THE INVENTION

This invention relates to the stacking of printed sheets of paper at the outfeed of a printing press, and more particularly to the inclusion in the stack of a plurality of backing boards separating the stack into a plurality of groups each containing a predetermined number of printed sheets.

Pads of printed paper sheets are made by assembling a predetermined number of printed sheets together with a backing sheet of stiff paperboard or the like, and gluing the assembly together at one edge. This is usually accomplished by inserting a plurality of backing boards at number intervals in the stack of printed sheets formed at the outfeed of a printing press.

The insertion of backing boards heretofore has been done manually, either as the stack is being formed, or after a formed stack is removed from the vicinity of the printing press. In the latter case, the counting of sheets into groups has been done either entirely manually, or by the use of a comb-like device that is inserted edgewise into the stack to form groups of approximate numbers. Backing boards then are inserted at the comb teeth separations. Alternatively, tabs are inserted into the stack at intervals as the sheets are counted by the printing press and then each tab is replaced manually with a backing board. In any case, the manual operation is time consuming and costly in terms of labor and production.

U.S. Pat. No. 4,624,452 discloses a board inserter that functions to insert a board onto a pre-counted stack of printed sheets while fingers intercept the path of the next following printed sheet momentarily to provide a space between sheets into which the board may be inserted. The mechanism by which the fingers are operated and controlled is complex, costly to produce and maintain and susceptible of faulty operation.

SUMMARY OF THE INVENTION

This invention provides for the incorporation of backing boards at spaced intervals as a stack of printed sheets is assembled at the outfeed of a printing press, by momentarily stopping the feeding of sheets periodically through the printing press while delivering backing boards to the stack. At the same time, if glued pads are to be produced, a cutting line may be laid across the uppermost printed sheet of a counted group before each backing board is deposited on the stack, the cutting line serving to facilitate cutting the stack at the backing boards after the boards and printed sheets in the stack have been bonded together at one edge by an adhesive.

It is the principal objective of this invention to provide a backing board incorporating method and apparatus of the class described which overcomes the aforementioned limitations and disadvantages of prior art mechanisms and methods.

Another object of this invention is to provide backing board incorporating apparatus of the class described which includes a mobile support that is adjustable vertically to adapt the board inserting apparatus to a wide variety of commercial printing presses.

A further objective of this invention is the provision of backing board incorporating apparatus of the class described which includes means for inserting a cutting line at intervals in a stack at the backing boards for cutting apart a glued stack into a plurality of pads each having a reinforcing backing board.

Still another objective of this invention is to provide backing board incorporating apparatus of the class described which is of simplified construction for economical manufacture, is precise in its operation and is versatile in its use with a wide variety of printing presses and paper sizes.

The foregoing and other objects and advantages of this invention will appear from the following detailed description, taken in connection with the accompanying drawings of a preferred embodiment.

DESCRIPTION OF THE PREFERRED EMBODIMENT

Figure 1:
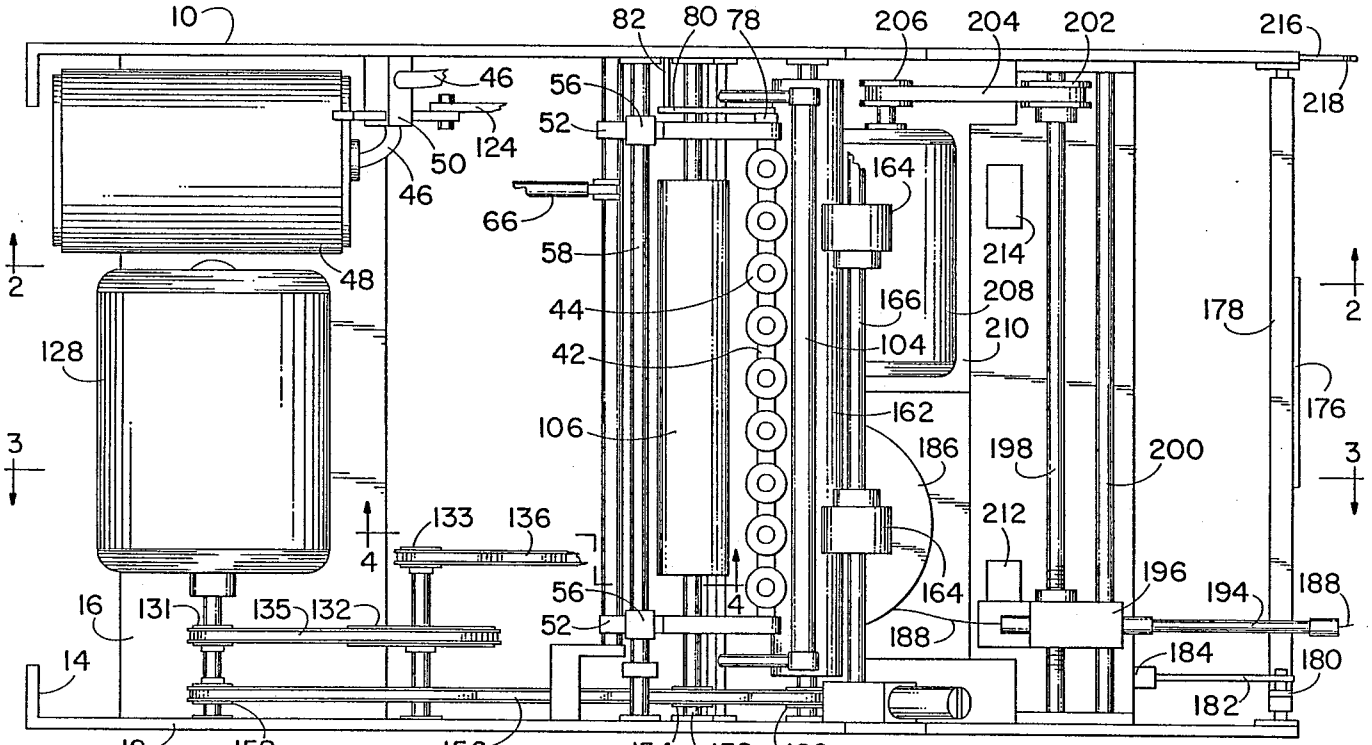
FIG. 1 is a plan view of a paper pad board inserter embodying the features of this invention, the paper board support plates being removed in order to expose internal mechanism.

The board inserting apparatus illustrated in the drawings includes a framework formed of opposite side walls 10 and 12, rear wall 14, bottom plate 16, front bottom wall 18 and front top plate 20.

Figure 2:
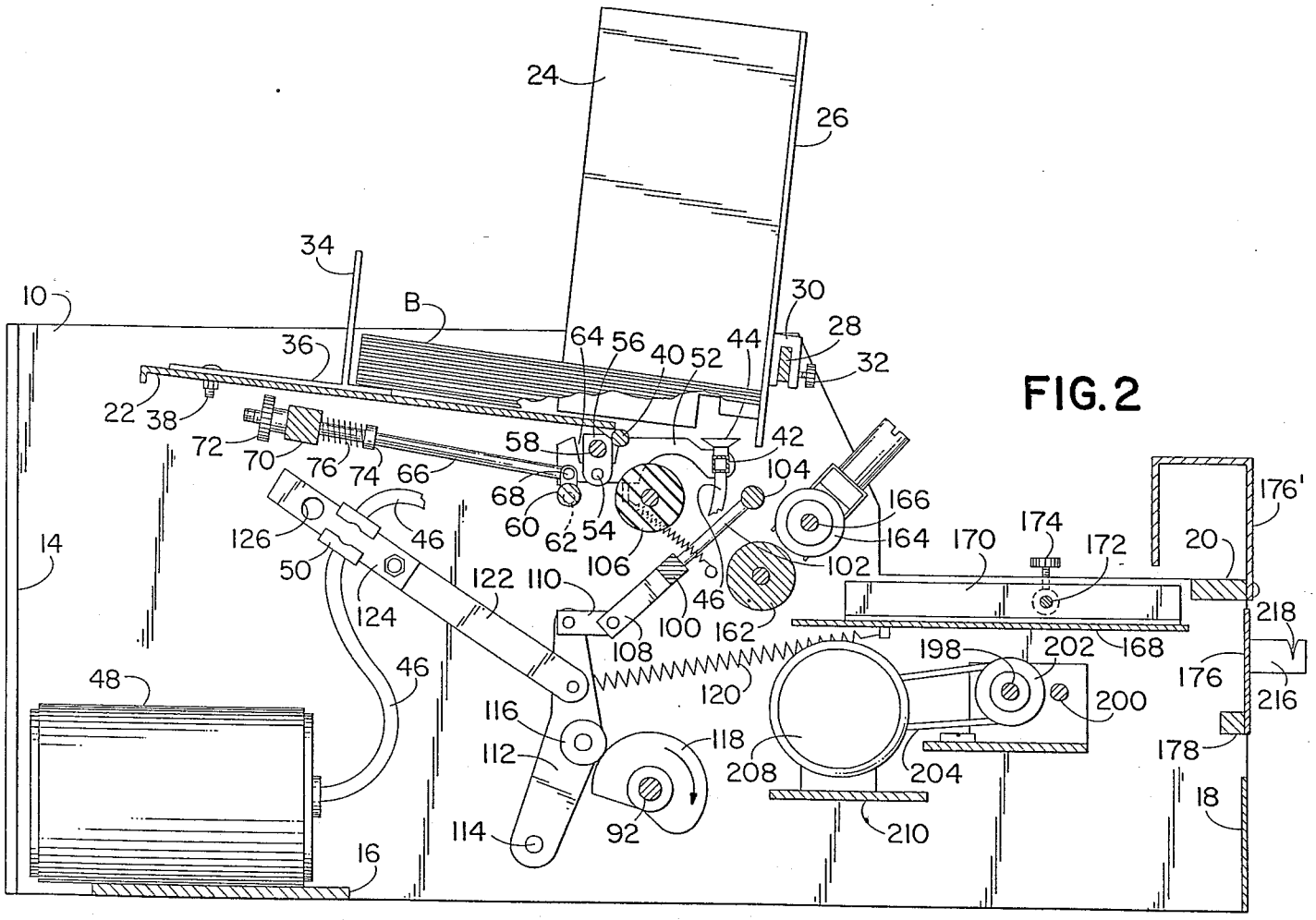
FIG. 2 is a vertical section taken on the line 2—2 in FIG. 1 showing a cam mechanism for controlling the suction cup vacuum delivery and feed arm movement.

A supply of relatively stiff backing boards B (FIG. 2) of paperboard, plastic or other suitable material, is stored in a delivery hopper formed of bottom plate 22 and opposite side plates 24 with integral transverse front plates 26. The bottom plate is secured between the framework side walls 10 and 12 and each of the side plates with its associated front plate is mounted for lateral adjustment along the transverse support bar 28 extending between the framework side walls. Each of the front plates 26 mounts a U-shaped clamp member 30 which is mounted slidably on the support bar for adjusting the lateral positions of the side plates 24 to accommodate backing boards of different widths. The clamp members 30 are secured in adjusted position along the support bar 28 by means of clamp screws 32.

The backing board hopper also includes a rear plate 34 provided with a rearwardly extending base section 36 supported slidably on the bottom plate 22. A clamp bolt 38 extends through a longitudinal slot in the base section 36 and through a registering hole in the bottom plate 22. The longitudinal slot in the base section 36 accommodates adjustment of the rear plate 34 toward and away from the front plates 26, to accommodate backing boards of various length. The clamp bolt 38 functions to secure the rear plate 34 in desired position of adjustment.

The bottom plate 22 of the hopper terminates rearward of the front plates 26 to provide a feeding space therebetween. A board guide roller 40 is mounted between the side walls of the framework adjacent the front edge of the bottom plate 22 and serves to guide the bottom backing board as it is pulled from the stack in the hopper.

A hollow vacuum manifold 42 extends freely between the side walls of the framework (FIG. 1) and communicates with a plurality of vacuum cups 44 spaced apart along the length of the manifold. The manifold is connected by a flexible hose 46 to a vacuum pump 48 which is driven by an integrated electric motor. The vacuum pump and motor combination is mounted on the bottom plate 16 of the framework. A control valve 50 is interposed in the hose to control the application of vacuum to the vacuum cups, as described more fully hereinafter.

The manifold and vacuum cup assembly is positioned for movement within the feeding space between the hopper front plates 26 and gide roller 40. Thus, the opposite ends of the manifold are journaled in the forward ends of a pair of laterally spaced operating arms 52 for movement in a curvelinear path relative to the overhead stack of backing boards. The arms are provided with enlarged rear mounting ends that are pivoted by pivot pins 54 in clevices which integrally depend from blocks 56. The blocks are mounted pivotally on an actuating rod 58.

Means is provided for adjusting the working height of the vacuum cups. Thus, an offset rod 60 (FIG. 2) is provided with eccentric ends 62 which are journaled in the side walls of the framework, with the offset rod underlying the rear end portions of the manifold support arms 52. The end portions are provided with slots 64 that accommodate the supporting blocks 56 with the end portions being free to be moved about the pivots 54 relative to the blocks by virtue of the slots. Such movement is effected by rotating the offset rod 60. For this purpose an adjustment rod 66 is pivotally attached at pin 68 to the offset rod 60. The adjustment rod extends rearwardly therefrom and is provided with a threaded end portion that extends through a bore in a transverse bar 70 fixed between the side walls of the framework. A knurled knob 72 is threaded onto the end portion and bears against the bar 70. The adjustment rod has a fixed collar 74 against which bears one end of a compression spring 76 encircling the rod. The other end of the spring bears against the bar 70.

Thus, manual rotation of the knob 72 causes the adjustment rod to be moved axially, and results in an effective clockwise or counterclockwise rotary movement of the offset rod 60. By virtue of the eccentric mounting of the offset rod, it will rise up against or move down from the end portions of the manifold supporting arms 52 and cause the arms to be moved up or down in respect to their supporting blocks 56 on the actuating rod 58. This causes the manifold 42 to be moved to higher or lower effective heights. Such action is governed by the type or condition of the backing boards, the necessity to lower or raise the vacuum cups being dictated by the need for better contact thereof with the bottom backing board in the stack.

One end portion of the manifold projects beyond the adjacent support arm 52 and is pivoted (FIG. 1) to a link 78 by a pin. The link 78 is pivoted to one end of a link 80 which is pivoted at the opposite end to a pivot pin 82 fixed to the side wall 10 of the framework. The links 78 and 80 secure the manifold 42 to the frame in a manner so as to effect an initial rearward rotating motion of the manifold before the manifold is moved downwardly under the actuation of the arms 52. This initial rotating motion effects initial rapid downward bending of the front end portion of the bottom backing board B to separate it from the next adjacent backing board.

The downward swinging movement of the manifold is controlled by the arms 52 under the action of a bell crank 84 (FIG. 3) which is pivoted intermediate its ends on a shaft 86 supported by the framework side wall 12. The lower end of the bell crank mounts a roller 88 that engages a cam 90 secured for rotation with a cam shaft 92. The cam shaft is journaled in end bearings supported by the side walls of the framework.

The upper end of the bell crank is connected pivotally through a link 94 to the lower end of an operating link 96 the upper end of which is fixed to the actuating rod 58. Thus, rotation of the cam 90 in the counterclockwise direction illustrated in FIG. 3 effects counterclockwise rotation of the actuating rod and consequent downward swinging movement of the manifold 42. A tension spring 98 is connected at one end to each of the arms 52 and at the opposite end to a side wall of the framework, to tension the arm.

A pressure roll support rod 100 (FIG. 2) is journaled rotatably between the side walls of the framework, and a pair of laterally spaced arms 102 extend therefrom to support at their outer ends a transversely extending pressure roll 104. Pivotal movement of the support rod thus moves the pressure roll toward and away from a drive roll 106, discussed in detail hereinafter, to clamp a backing board B between them. A lever 108 extends downward from the support rod and is connected at its lower end pivotally through a link 110 to the upper end of a cam follower lever 112. This lever is mounted pivotally at its lower end on a shaft 114 extending from the side wall 10 of the framework.

A cam follower roller 116 on the lever is in rolling engagement with the outer surface of a cam 118 secured for rotation with the cam shaft 92 which also mounts the cam 90 discussed hereinbefore. A tension spring 120 is connected at one end to the cam follower lever and at its opposite end to a fixed position relative to the framework, and serves to urge the cam follower roller 116 into rolling engagement with the cam 118.

The cam follower lever 112 also pivotally connects one end of an elongated vacuum valve arm 122 which is connected to and operates the sliding valve bar 124 associated with the control valve 50 in the vacuum hose 46. Thus, in the position illustrated in FIG. 2 the control valve opens the hose to communicate the source 48 of vacuum with the vacuum cups 44, for engaging the forward portion of the bottommost backing board B in the hopper stack and pulling it down over the roller 40 in preparation for engaging it with the drive roll 106. Thereafter, when the cam 118 has rotated clockwise to bring its flattened portion into engagement with the cam follower roller 116, the pressure roll 104 is swung rearward toward the drive roll 106 to clamp the backing board between them.

Simultaneously therewith, the vacuum valve arm 122 has been moved forwardly to bring the exhaust opening 126 in the valve bar 124 into registry with the port in the control valve 50, to break the vacuum to the vacuum cups 44. The backing board thus is released from the vacuum cups for retraction from under the stack by operation of the drive roll 106.

The cam shaft 92 is coupled releasably to an electric drive motor 128 (FIG. 3) through an electrically controlled clutch mechanism. One section 130 (FIG. 4) of the clutch mechanism is secured to the drive motor through sprockets 131, 132, 133 and 134 and chains 135 and 136 (FIGS. 1 and 3), the clutch section 130 being rotated continuously by the electric motor. A second section 138 (FIG. 4) of the clutch mechanism is connected to the cam shaft 92 and is coupled releasably to the first named section 130 of the clutch assembly by operation of a latch ring 140 on the second clutch section (FIG. 4). The latch ring is provided with a shoulder 142 for releasably engagement by a pawl 144 mounted pivotally on a clutch support plate 146 secured to the bottom plate 16 of the framework. The pawl is connected to the armature 148 of an electric solenoid 150 which, upon activation, retracts the armature and disengages the pawl from the shoulder of the clutch ring. Thereupon the two sections of the clutch assembly are coupled together for simultaneous rotation through one operating cycle of 360'. The paul then engages the shoulder on the clutch ring and disengages the two sections of the clutch assembly, stopping the rotation of the cam shaft.

Figure 3:
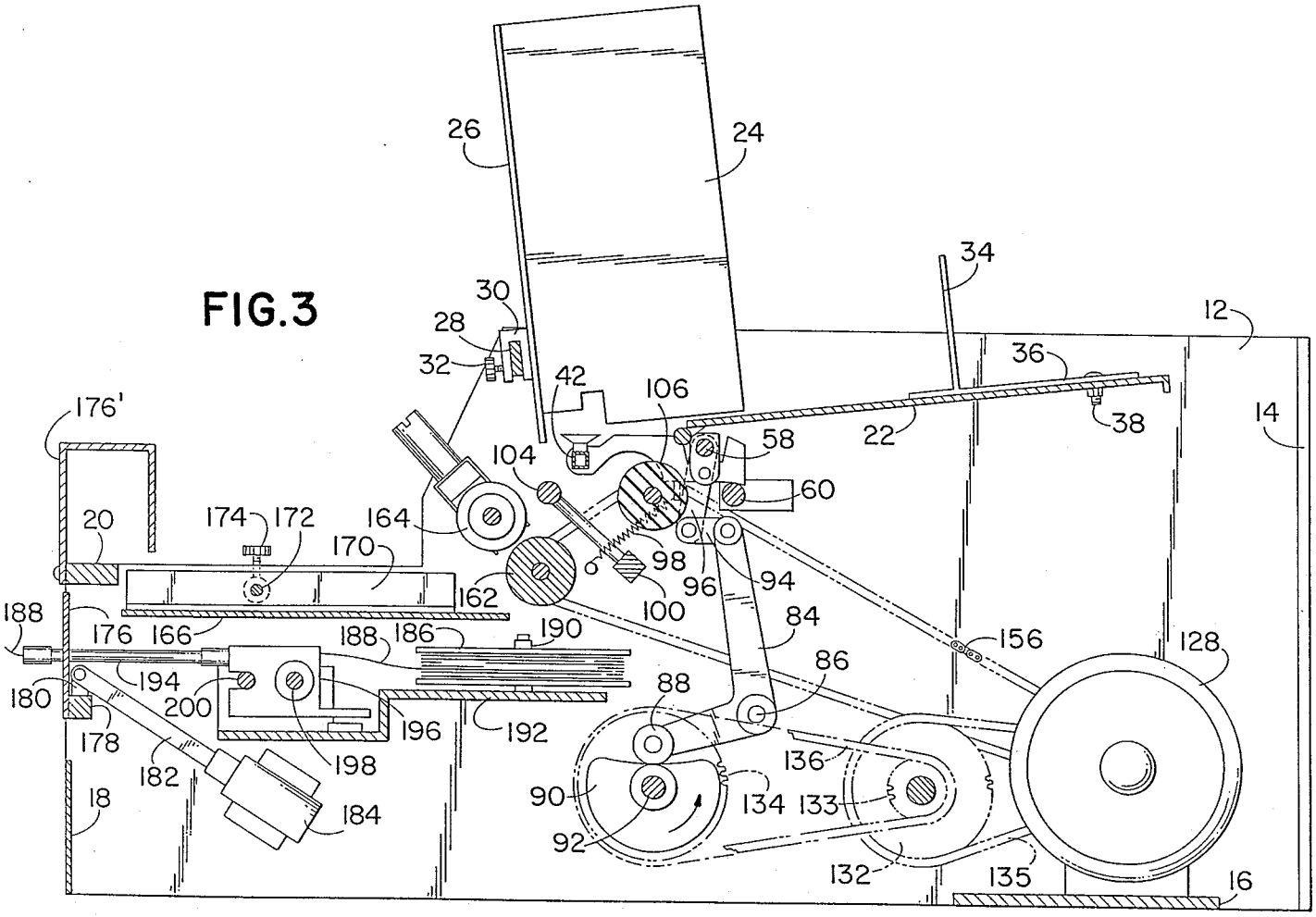
FIG. 3 is a vertical section taken on the line 3—3 in FIG. 1 showing a cam mechanism for controlling movement of the suction cup feed assembly.
Figure 4:
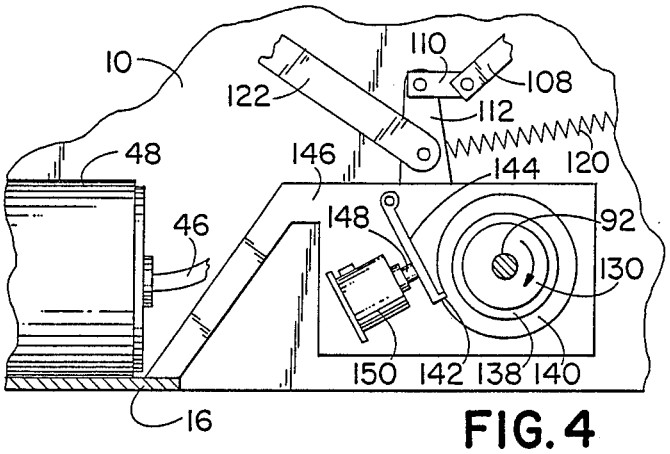
FIG. 4 is a fragmentary vertical section taken on the line 4—4 in FIG. 1 showing a clutch control for the cam mechanism.

Referring to FIGS. 1 and 3 of the drawings, the drive roll 106 is mounted on a shaft 152 journaled in bearings at the opposite side walls of the framework. A sprocket 154 on the shaft engages a drive chain 156 which also engages a sprocket 158 on the output drive shaft of the drive motor 128. The drive chain 156 also engages a sprocket 160 on the shaft of the driven outfeed roll 162. It will be understood that the drive roll and outfeed roll are driven at the same speed.

A pair of idler outfeed rolls 164 are spaced apart laterally on a shaft 166 which extends between the side walls of the framework and are positioned closely adjacent the driven outfeed roll 162 for urging a backing board B into frictional engagement with the driven outfeed roll.

As the bottommost backing board is outfed from the hopper stack through the outfeed roll assembly, it is directed onto the outfeed table 168 (FIGS. 2 and 3) which is secured to and extends between the side walls of the framework. A pair of laterally spaced and laterally adjustable guide plates 170 are supported by a transverse rod 172 which is secured at its opposite ends to the framework side walls. A clamp screw 174 is associated with each guide plate for securing it releasably to the transverse rod in desired positions of adjustment.

At the outfeed end of the framework the opening between the front bottom wall 18 and front top plate 20 is intermittently closed by a paper stop plate 176 secured at its bottom end to a transverse pivot rod 178 supported pivotally at its opposite ends in bearings carried by the side walls of the framework. A short lever 180 extending upward from the pivot rod is secured at its upper end pivotally to the outer end of the arm 182 of an electric solenoid 184 mounted on the framework side wall 10. The paper stop functions in its operative position illustrated in FIG. 2 as a barrier to prevent printed paper sheets stacked at the printing press from entering the front end of the board inserting apparatus as the sheets are jogged to form a vertically aligned stack at the outfeed end of the printing press. A transverse stop frame 176' extends upwardly from the top plate 20 to intercept sheets being delivered by the press to the stack.

The board inserting apparatus of this invention also preferably includes means to facilitate the separation of a plurality of paper pads produced from the stack of printed paper sheets and intermittently interposed backing boards. Such a stack is produced by the intermittent insertion of a backing board into the stack after a predetermined number of printed paper sheets have been deposited in the stack at the outfeed end of the printing press. The assembly of printed paper sheets and interposed backing boards are glued together along the side of the stack facing outwardly from the printing press. Thereafter, the stack is cut apart at each backing board to provide a plurality of pads of printed paper sheets reinforced by a backing board.

In the embodiment illustrated in the drawings, a spool 186 (FIG. 1) of strong thread, fishing line, or other suitable line material 188 is mounted for rotation about a central spindle 190 projecting upwardly from a supporting plate 192 that extends transversely between the side walls of the framework. The free outer end of the line 188 extends forwardly through an elongated hollow line guide tube 194 that terminates at its forward end forwardly of the paper stop plate 176. The guide tube is mounted on a carriage 196 that is arranged to move back and forth transversely between the side walls of the framework. This movement is provided in the embodiment illustrated by a threaded drive shaft 198 which extends transversely between the side walls of the framework and is journaled for rotation in end bearings supported by the side walls. The threaded shaft extends through a threaded opening transversely through the carriage. The carriage is stabilized by means of a guide rod 200 that extends transversely between the side walls of the framework and extends slidably through a transverse bore in the carriage, forwardly of the drive shaft.

The drive shaft mounts a sprocket 202 (FIG. 1) which is coupled through a drive chain 204 to a sprocket 206 mounted on the output shaft of an electric drive motor 208 supported by a transverse plate 210 extending between the side walls of the framework. The electric motor is of the reversible type, the reversing of which is controlled by a pair of laterally spaced switches 212 and 214 in the electric circuit of the drive motor 208. As illustrated, the switches are shown to be of the magnetic proximity type that are activated upon sensing of the proximity of the carriage 196. Thus, as the carriage approaches either end of the drive shaft, the associated proximity switch effects reversal of the drive motor and consequent movement of the carriage in the opposite direction.

The free end of the cutting line 188 extending from the forward end of the line guide tube 194, is secured temporarily to a fixed point disposed laterally outward of the stack formed at the outfeed end of the printing press. Although this point of attachment may be provided at one side of the printing press, it preferably is provided at one side of the board inserting apparatus of this invention. As illustrated, it is provided as a forward extension 216 of the forward end of the framework side wall 10, and the line anchor is formed as a shallow V notch 218 (FIG. 2) in the extension.

Figure 5:
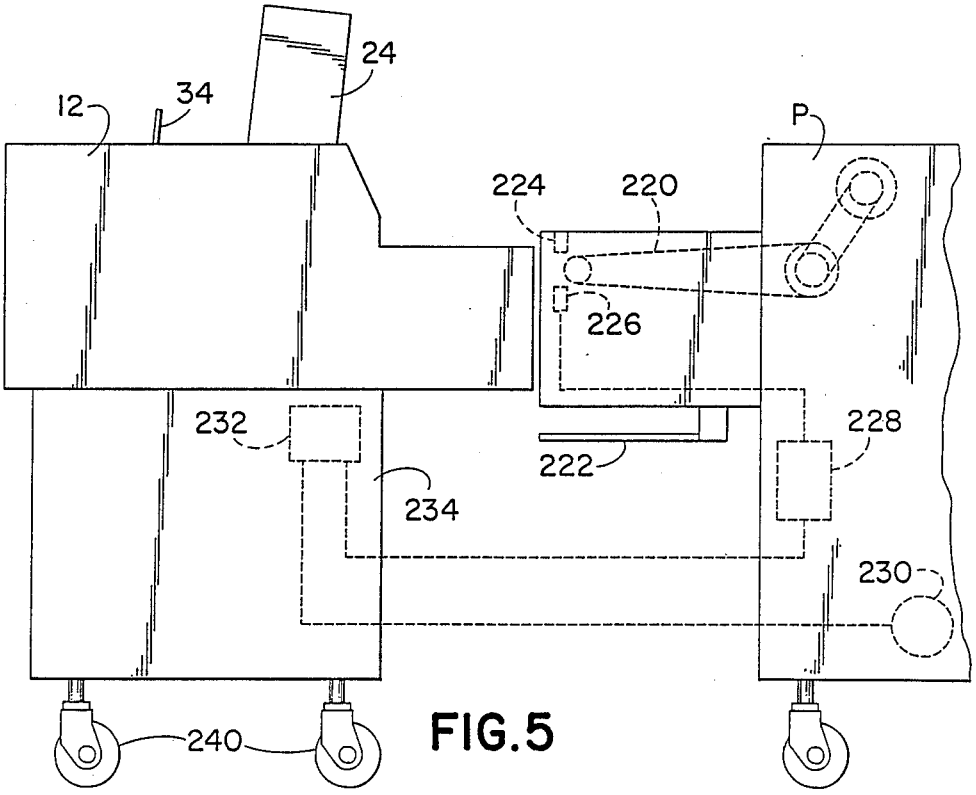
FIG. 5 is a fragmentary side elevation showing schematically the cooperative relationship between a conventional printing press and the board inserter of this invention.
Figure 7:
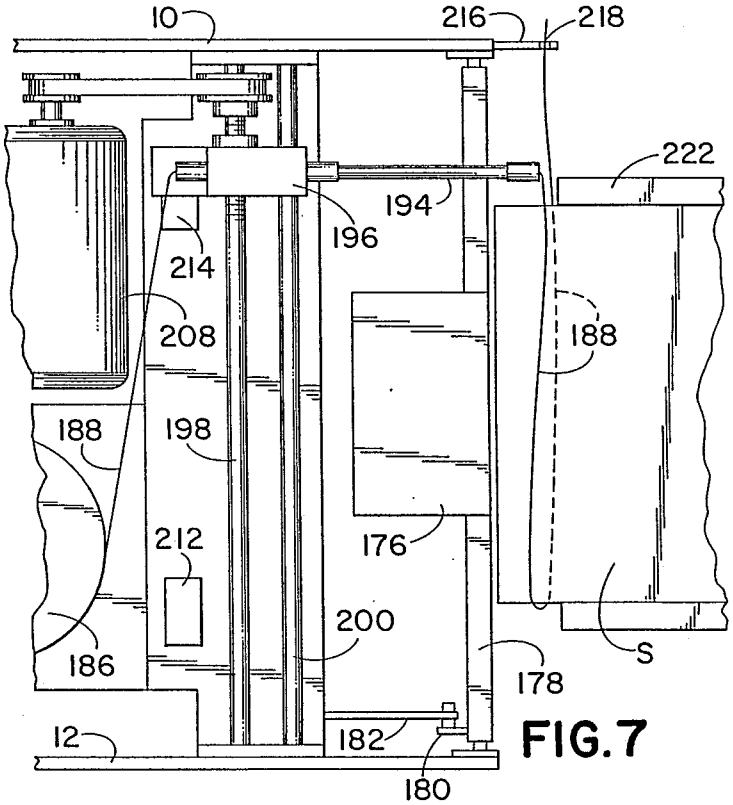
FIG. 7 is a fragmentary plan view similar to FIG. 6 showing the line feeder mechanism at the opposite end of traversal of the paper stack.

Referring to FIG. 5 of the drawings, there is illustrated schematically the cooperative association of the board inserting apparatus of this invention and a conventional printing press P. The outfeed end of the printing press includes means, such as chain conveyors 220, for delivering the printed sheets S (FIGS. 6 and 7) one at a time to the stacking station at the outfeed end of the press. In the embodiment illustrated, the stacking station is provided by an elevator platform 222 upon which the sheets are to be assembled in a vertical stack. Sheet counter mechanism, such as the photocell 224 and detector 226 assembly illustrated, is associated with an electronic counter 228 for counting the printed sheets as they are delivered to the elevator. The counter controls the indexing of the elevator downwardly step-wise as the printed sheets accumulate in the stack.

The printing press performs the printing operation by delivering blank sheets of paper to the printer mechanism, one sheet at a time, by electrically actuated sheet delivery mechanism. In the embodiment illustrated schematically in FIG. 5, the delivery mechanism includes a conventional vacuum manifold and suction cup assembly of the type described hereinbefore, with the vacuum supply to the manifold being controlled by an electrically actuated valve 230.

In accordance with this invention, means is provided for interupting the delivery of a printed sheet to the stack on the elevator 222 momentarily when it is desired to deposit a backing board B onto the stack. In the embodiment illustrated in FIG. 5, this is achieved by an electronic control unit 232 associated with the board inserting apparatus of this invention. The control unit is connected electrically to the output of the counter 228 to receive an electric signal from the counter when a predetermined number of printed sheets have been deposited on the elevator. The electric signal supplied to the control unit activates the latter to supply an electric signal to the electrically actuated vacuum control valve 230 to cut off the vacuum to the sheet feeding manifold, whereby to prevent the delivery of a blank sheet of paper to the printing press and hence a printed sheet of paper to the stack. During this momentary delay in delivery of the next printed sheet to the stack, the board inserting apparatus, including the solenoids 150 and 184, is activated by the control unit 232 to deliver a backing board over the last deposited printed sheet on the stack.

Figure 6:
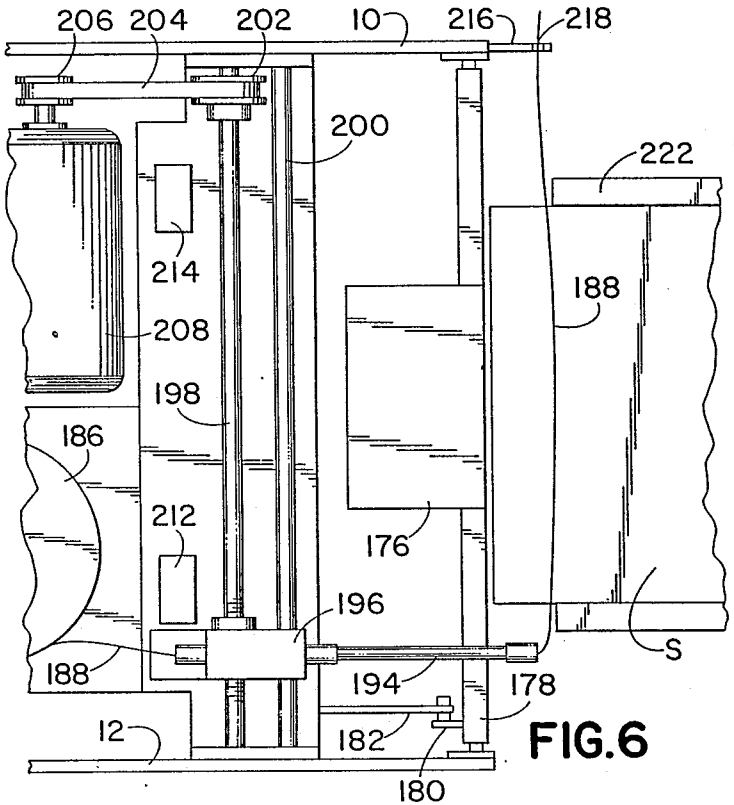
FIG. 6 is a fragmentary plan view of the board delivery end of the inserter in operative relation to the printed paper delivery end of a printing press and showing mechanism for feeding a pad cutting line to a stack of printed papers at the outfeed end of a printing press.

In the event the stack accumulated on the elevator is to be formed into a plurality of pads in which a predetermined number of printed sheets and a reinforcing backing board are bonded together along one edge by a coating of adhesive, the pad cutting line mechanism is activated to place a length of cutting line 188 between each backing board and the next adjacent underlying printed sheet. Thus, referring particularly to FIGS. 6 and 7 of the drawings, FIG. 6 shows the cutting line being extended transversely across the uppermost printed sheet S on the stack, by movement of the carriage 196 and line guide tube transversely to a position closely adjacent the framework side wall 12. This movement of the carriage and guide tube is effected by the controller 232 while the paper stop plate 176 is retracted to allow traversal of the line guide tube.

As the line guide tube reaches its position adjacent the side wall 12 the controller 232 activates the clutch solenoid 150 to rotate the cam shaft 92 and cams 90 and 118 through 360' to effect the delivery of a backing board from the hopper stack through the drive and outfeed rolls and the open front end of the apparatus and onto the uppermost printed sheet in the stack, overlying the cutting line 188. The controller 232 then actuates the vacuum valve 230 of the printing press to resume the delivery of blank paper sheets to the press. Simultaneously, the controller activates the stop plate solenoid 184 and the paper stop plate 176 is returned to closed position (FIG. 2) to provide a stop for the printed sheets of paper being delivered to the stack.

When the desired number of printed sheets have been deposited upon the stack above the previously deposited backing board, the foregoing cycle of operation is repeated, to retract the paper stop plate 176, drive the line guide tube carriage 196 transversely to the position closely adjacent the framework side wall 10 (FIG. 7) to deposit a length of cutting line 188 transversely across the uppermost printed sheet S in the stack and then to deliver the next succeeding backing board from the hopper and through the open front end of the board inserting apparatus and onto the stack above the cutting line.

The foregoing sequence of operation is repeated until the stack on the printing press elevator 222 has reached a desired height. The cutting line 188 then is severed at the forward end of the guide tube 194, the initial end of the line is removed from the anchor notch 218, and the stack is removed from the elevator to a location where the side of the stack adjacent the transverse cutting lines is coated with an adhesive to bond all of the printed sheets and interposed backing boards together. When the adhesive has cured, the terminal end of the cutting line 188 is pulled forwardly through the adhesive coating to effect cutting the latter immediately under the uppermost backing board. This results in separation of the uppermost pad from the stack. The cutting line is continued to be pulled forwardly through the adhesive layer until all of the pads have been separated from each other.

Figure 8:
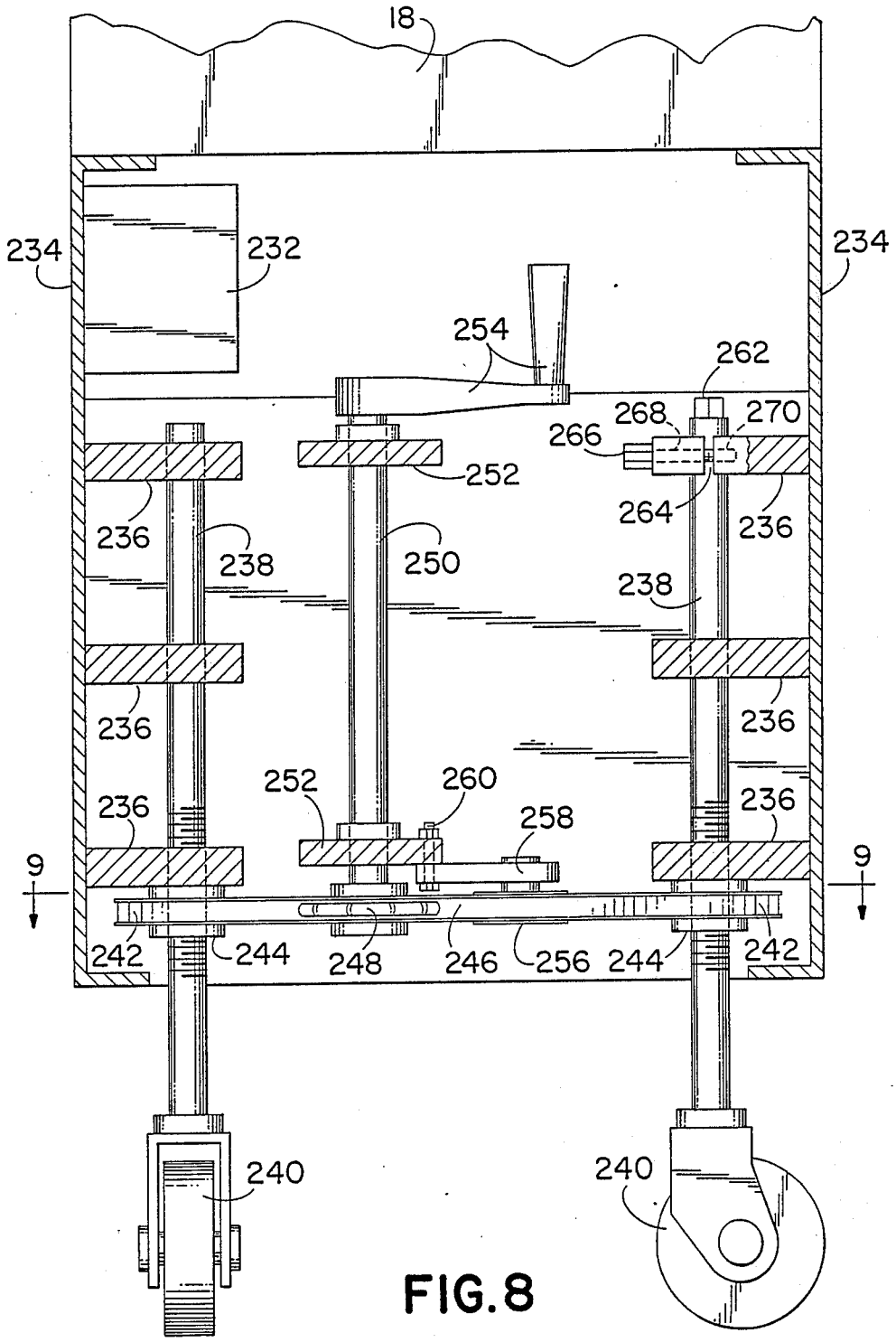
FIG. 8 is a vertical section taken on the line 8—8 in FIG. 9 showing a mobile elevator mechanism for supporting the inserter of FIG. 1 for vertical adjustment relative to a printing press.
Figure 9:
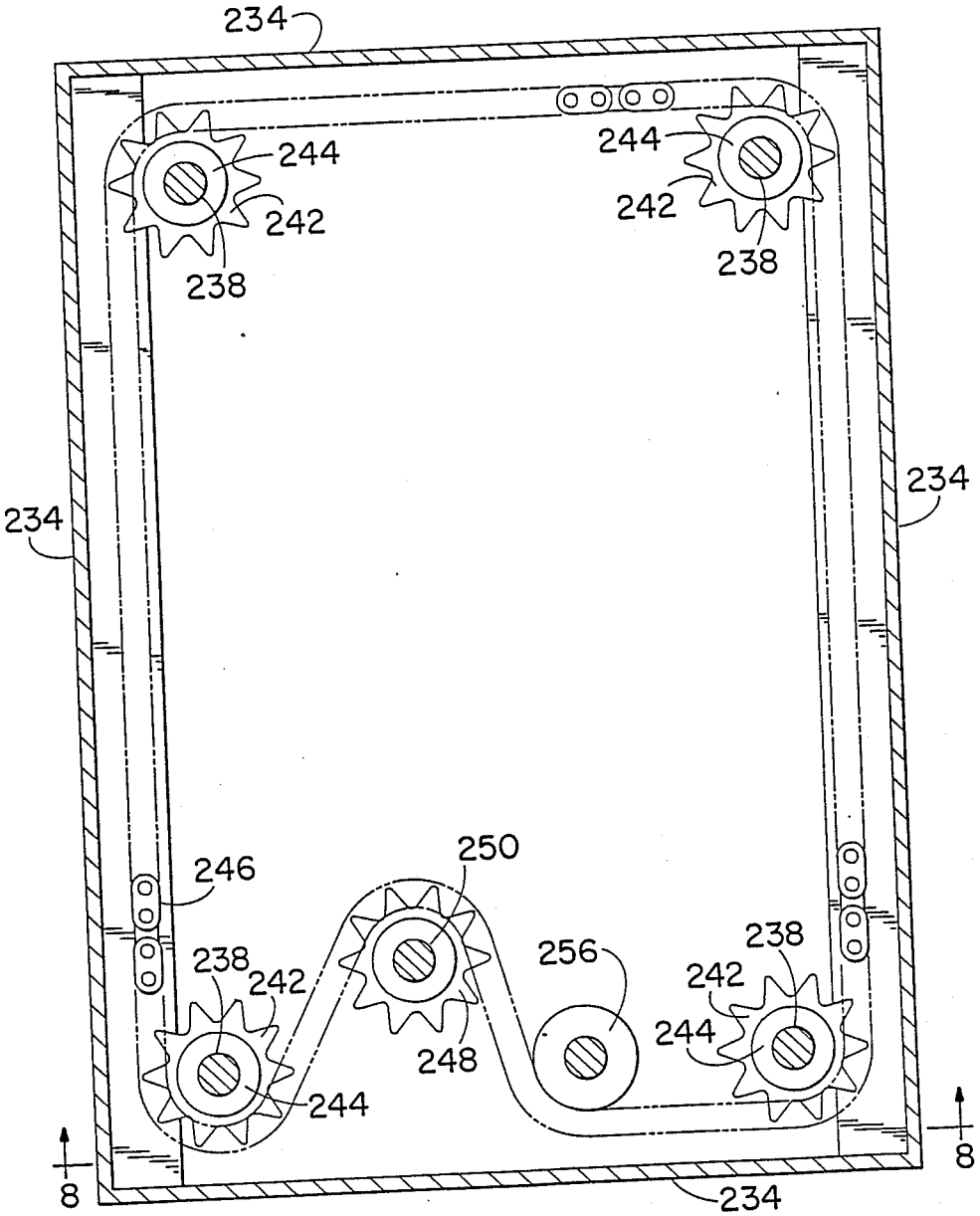
FIG. 9 is a horizontal section taken on the line 9—9 in FIG. 8 showing the drive assembly of the elevator mechanism.

Means also is provided in accordance with this invention to adapt the board inserting apparatus to a wide variety of conventional printing presses. Referring to FIGS. 8 and 9 of the drawings, there is provided a hollow support housing formed of interconnected vertical side walls 234. Extending inwardly from each of the four corners of the housing is a plurality of vertically spaced bearing plates 236 provided with vertically aligned openings for freely receiving thereto the elongated leg 238 supporting a castor wheel 240. An intermediate portion of each leg is threaded and receives thereon a sprocket 242, the hub 244 of which is provided with a threaded bore. The sprocket on each leg underlies one of the bearing plates, preferably the lowermost bearing plate as shown, whereby the housing is supported upon the sprocket hubs.

The sprockets are interconnected by a common drive for simultaneous rotation in the same direction. As illustrated, this common drive is formed of an endless drive chain 246 engaging the four sprockets as well as a drive sprocket 248 secured to the lower end of a crankshaft 250. The crankshaft is journaled for rotation in vertically spaced bearing plates 252 secured to one of the side walls of the housing. The upper end of the crankshaft is provided with a crank handle 254 by which to rotate the drive sprocket. A chain tightening roller 256 is supported on a shaft adjacent one end of a lever arm 258 the opposite end of which is secured adjustably to one of the bearing plates 252 by means of a clamp bolt 260.

From the foregoing it will be understood that rotation of the crank handle and the attached drive sprocket effects simultaneous rotation of the sprockets on the threaded sections of the castor wheel legs. The sprockets thus move axially along the legs vertically up or down, to move the housing correspondingly in the same direction. The housing 234 supports the framework of the board inserting apparatus described hereinbefore, and thus the latter is adjustable in height to match the delivery of backing boards therefrom to the level of a stack of printed sheets at the outfeed of any one of a variety of conventional printing presses.

Means also is provided for adjusting one of the castor wheel legs 238 independently of the others to accommodate undulations or other uneven portions of a supporting floor. Thus, referring to FIG. 8 of the drawings, the castor wheel leg at the right side of the housing is provided at its upper end with a square or other non-circular fitting 262 for the reception of a wrench or other turning tool by which to rotate the leg independently of the other castor wheel legs. Thus, by rotating the leg relative to the associated sprocket 242, which is prevented from rotating by virtue of its coupling to the other three sprockets through the drive chain, the leg is moved vertically up or down independent of the other castor wheel legs to adjust to the uneveness of the underlying floor.

If desired, the adjustable leg may be secured against further rotation from its adjusted position by providing one of the associated bearing plates 236 with a clamp mechanism for securing the leg against rotation. In the embodiment illustrated, this is provided in the upper bearing plate 236' by a slot 264 extending outwardly from the leg guide opening, and a clamp screw 266 extending through an unthreaded bore 268 and across the slot and into a threaded bore 270. Thus, tightening the clamp screw draws together the sections of the bearing plate on opposite sides of the slot 264 and clamps the leg against rotation.

Any two of the four caster wheels 240 may be provided with conventional and well known releasably lockable brakes to prevent movement of the support housing when the board inserting apparatus is in operative position at the outfeed end of a printing press. It is preferred that the brakes be utilized with the front pair of caster wheels.

It is to be noted from FIGS. 5 and 8 that the electronic controller 232 is conveniently contained within the housing 234.

FIGS. 10–14 show an alternative arrangement for interrupting the delivery of a printed sheet S from the printing press P to a stack at the elevator 222 of the press. Thus, the transverse front top plate 20 of FIG. 1 is replaced with a hollow tube 20' of rectangular cross section. A sheet interruptor plate 272 is supported upon the upper surface of the tube 20' and is secured to a shaft 274 which extends through ertically aligned bores in the tube. The plate 272 thus is pivotable about the axis of shaft 274.

A gear 276 is secured to shaft 274 within the hollow tube, and the gear engages the teeth of a transversely elongated rack 278 contained within the tube for movement therein in the transverse direction of the framework.

A pin 280 extends from the rack through a slot 282 in the tube for conection to one end of a link 284. The opposite end of the link is connected pivotally to one end of a bell crank 286 mounted intermediate its ends on the framework by pivot 288. The opposite end of the bell crank is connected pivotally to one end of a link 290 the opposite end of which is connected pivotally to a bracket 292 secured to the transverse pivot rod 178 that mounts the stop plate 176.

Figures 10, 11, 12, 13, 14:
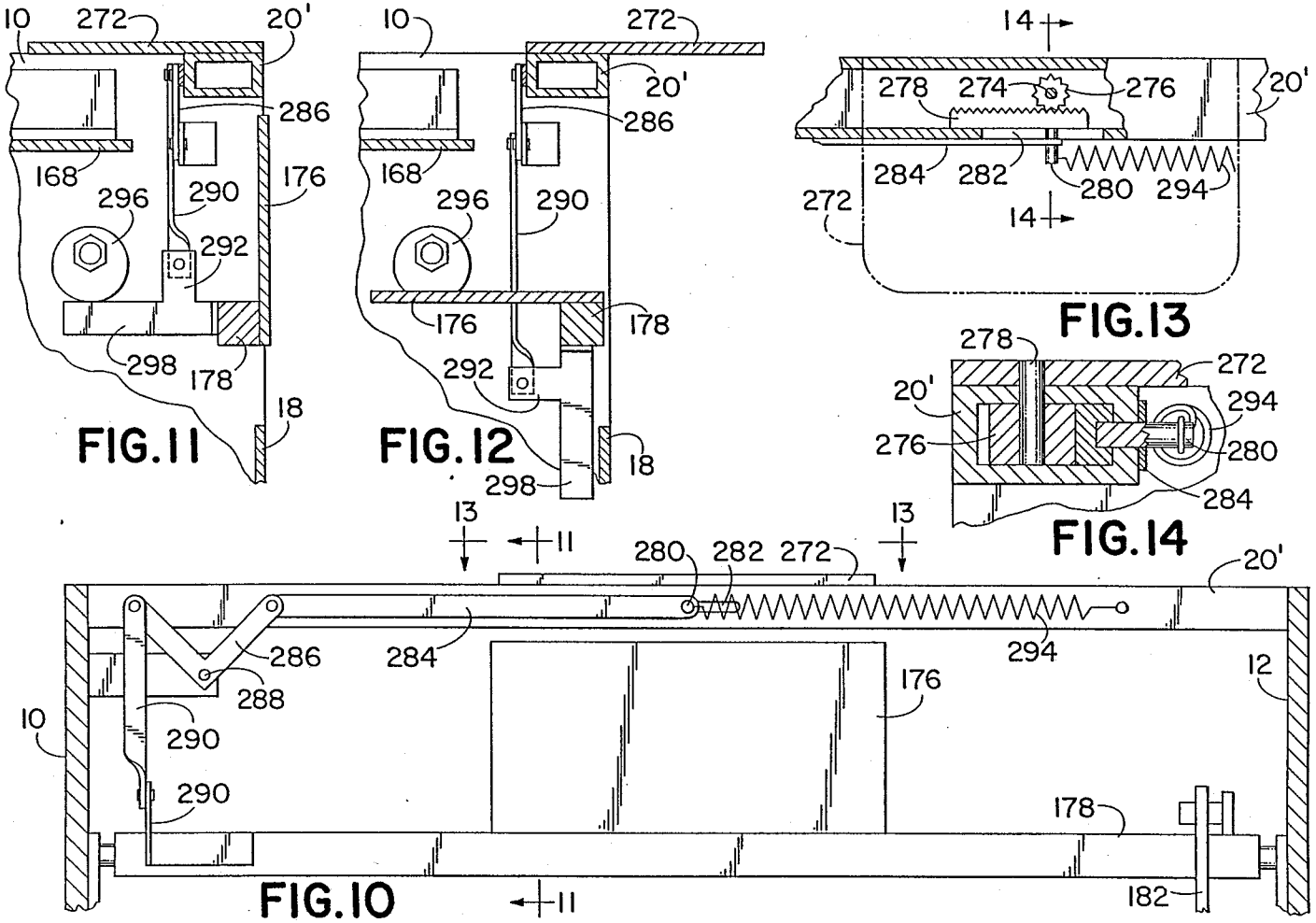
FIG. 10 is a fragmentary vertical section through the front end portion of the board inserter of FIG. 1 showing an alternative arrangement for interupting the delivery of a printed sheet to a stack at the outfeed end of the printing press when it is desired to deposit a backing board onto the stack.
FIG. 11 is a fragmentary sectional view taken on the line 11—11 in FIG. 10.
FIG. 12 is the same fragmentary sectional view as FIG. 11 but showing the paper stop retracted and the paper interrupter extended, preparatory to the delivery of a backing board from the board inserter.
FIG. 13 is a fragmentary plan view as viewed in the direction of the arrows 13—13 in FIG. 10, a portion of the structure being broken away to disclose internal details.
FIG. 14 is a fragmentary section taken on the line 14—14 in FIG. 13.

A coil spring 294 is connected at one end to the pin 280 and at the opposite end to the tube 20', to urge the rack 278 toward the right in FIG. 13. The interruptor plate 272 thus is urged to the retracted position of FIGS. 10, 11, 13, and 14.

A manually rotatable cam 296 is mounted on the framework for abutment by an arm 298 extending from the bracket 292. Adjustment of the cam varies the degree of clockwise rotation of the pivot rod 178 (FIG. 13) in the retracting direction of the stop plate 176, to ensure proper positioning of the stop plate.

In the inactivated condition of solenoid 184, the paper stop plate 176 is extended vertically upward to prevent printed sheets from entering the front end of the board inserter, and the paper interrupter plate 272 is retracted, both as shown in FIGS. 10, 11, 13 and 14. Upon activation of the solenoid 184 by the control unit 232, the pivot rod 178 is rotated to retract the stop plate 176 to the position shown in FIG. 12. This rotation of pivot rod 178 also effects movement of the rack 278 to the left in FIG. 13 and consequent pivoting of the interrupter plate 272 clockwise from the position of FIG. 13 to the forwardly extended position of FIG. 12.

In said forwardly extended position the interrupter plate 272 intercepts the leading end of printed sheets S being delivered by gravity from the printing press P to the stack on the elevator 222. Thus, the gravity fall of the next succeeding printed sheet toward the stack is interrupted momentarily while a backing board B is delivered from the inserter to the stack of sheets on the elevator.

From the foregoing, it will be apparent that the present invention provides for the insertion of backing boards at predetermined intervals in the stack of printed paper sheets at the outfeed end of a wide range of types and sizes of printing presses, in an efficient manner. The board inserting apparatus is very versatile in adapting to a wide variety of printing presses and types and sizes of backing boards. It also affords the advantages of inserting a cutting line in the stack of printed papers to divide the stack into a plurality of pads. Still further, it affords adjustment of the board inserting apparatus to various heights dictated by the printing press with which it is to be associated. It also affords a positive support for the apparatus even on an uneven floor.

It will be apparent to those skilled in the art that various changes may be made in the size, shape, type, number and arrangement of parts described hereinbefore, without departing from the spirit of this invention and the scope of the appended claims.

I claim:

1. The method of incorporating a plurality of backing boards into a stack of printed paper sheets as the stack is formed at the outfeed end of a printing press, wherein the printing press delivers blank paper sheets one at a time to a printing station and then the printed paper sheets are delivered one at a time from the printing station to a stacking station at the outfeed end of the press to form a stack from the opposite direction and wherein the backing boards are delivered to the stack one at a time from the outfeed end of a board inserter, the method comprising placing a barrier at the outfeed end of the board inserter to prevent printed sheets from the printing press from entering the outfeed end of the board inserter during delivery of printed sheets to the stack at the stacking station, and then after the last sheet of each group of a predetermined number of sheets has been deposited at the stacking station simultaneously removing said barrier and stopping the delivery of a next succeeding paper sheet to the stack momentarily while a backing board is delivered from the outfeed end of the board inserted to the stack at the stacking station of the printing press.

2. The method of claim 1 wherein the stopping of delivery of the next succeeding printed paper sheet to the stack is achieved by stopping delivery of the corresponding blank paper sheet to the printing station.

3. The method of incorporating a plurality of backing boards into a stack of printed paper sheets as the stack is formed at the outfeed end of a printing press, wherein the printing press delivers blank paper sheets one at a time to a printing station and then the printed paper sheets are delivered one at a time from the printing station to a stacking station at the outfeed end of the press to form a stack, the method comprising stopping the delivery of a next succeeding blank paper sheet to the printing station, after the last sheet of each group of a predetermined number of printed sheets has been deposited at the stacking station, for a time sufficient to deposit a backing board onto the uppermost printed paper sheet in the stack.

4. The method of incorporating a plurality of backing boards into a stack of printed paper sheets as the stack is formed at the outfeed end of a printing press, wherein the printing press delivers blank paper sheets one at a time to a printing station and then the printed paper sheets are delivered one at a time from the printing station to a stacking station at the outfeed end of the press to form a stack, the printing press having an electrical counter which counts the printed paper sheets as they are delivered to the stacking station of the printing press, the method comprising utilizing the electrical counter to effect stopping the delivery of a next succeeding printed paper sheet to the stack after a predetermined number of counted printed paper sheets has been deposited at the stacking station, for a time sufficient to deposit a backing board onto the uppermost printed paper sheet in the stack.

5. The method of incorporating a plurality of backing boards into a stack of printed paper sheets as the stack is formed at the outfeed end of a printing press, wherein the printing press delivers blank paper sheets one at a time to a printing station and then the printed paper sheets are delivered one at a time from the printing station to a stacking station at the outfeed end of the press to form a stack, the method comprising stopping the delivery of a next succeeding paper sheet to the stack after the last sheet of each group of a predetermined number of sheets has been deposited at the stacking station for a time sufficient to deposit a backing board onto the uppermost printed paper sheet in the stack, depositing a cutting line transversely on a substantially straight line across the uppermost printed paper sheet in the stack, depositing a backing board over the cutting line, depositing additional sheets of printed paper over the backing board, repeating the depositing steps to form a stack of printed paper sheets with interposed cutting lines and backing boards, applying a coating of adhesive over one edge of the stack to bond the printed paper sheets and backing boards together, and them pulling the cutting lines outwardly through the adhesive coating to sever the stack into a plurality of pads each having a reinforcing backing board.

6. In combination with a printing press having electrically actuated blank paper infeed means for delivering blank paper sheets one at a time to a printing station, electrically actuated printed paper outfeed means for delivering printed paper sheets one at a time to an outfeed stacking station, and paper sheet counter means capable of providing an electric output signal after reaching selected count values, apparatus for incorporating backing boards at spaced intervals in a stack of printed paper sheets at the outfeed stacking station of the printing press, comprising:

(a) a frame having an outfeed end positioned closely adjacent the stacking station of the printing press, (b) backing board hopper means on the frame for storing a stack of backing boards, (c) electrically actuated feed means on the frame for delivering backing boards from the hopper means one at a time through the outfeed end of the frame to the outfeed stacking station of the printing press, (d) electrically actuated stop means on the outfeed end of the frame movable between an extended position for preventing printed sheets from the printing press from entering the outfeed end of the frame and a retracted position for allowing delivery of a backing board through said outfeed end of the frame to the stacking station of the press, (e) electrically actuated sheet delivery delay means operable to delay the delivery of a printed paper sheet to the outfeed stacking station of the printing press, and (f) electric control means connected to the electrically actuated feed means, stop means and sheet delivery delay means and operable by an electric output signal from the counter means to activate the feed means, stop means and sheet delivery means substantially simultaneously to actuate the stop means to said retracted position, to actuate the sheet delivery delay means to delay the delivery of a next succeeding printed paper sheet to a stack of printed paper sheet at the stacking station, and to actuate the feed means to deliver a backing board past the retracted stop means and onto a stack of printed paper sheets while the next succeeding printed paper sheet is being delayed delivery to the stack.

7. The combination of claim 6 wherein the sheet delivery delay means includes the paper infeed means of the printing press and the electric control means is connected to the electrically actuated paper infeed means and is operable by the electric output signal from the counter means to stop the feeding of blank paper sheets to the printing station.

8. The combination of claim 6 wherein the sheet delivery delay means includes arm means on the frame movable between an operative position extending into the path of gravity fall of printed paper sheets to the stacking station of the printing press and a retracted position out of said path, and electric drive means engaging said arm means for moving said arm means between said operative and retracted positions, the electric drive means being connected to the electric control means.

9. The combination of claim 6 including cutting line support means on the frame, and cutting line feed means on the frame operable to deposit a length of cutting line transversely across the uppermost sheet on the stack at the stacking position.

10. The combination of claim 9 wherein the cutting line feed means comprises a cutting line guide extending forwardly of the outfeed end of the frame for depositing cutting line on the stack, a cutting line guide carriage mounted on the frame for reciprocative transversal thereof, and power means engaging the carriage for reciprocating the latter when the stop means is in said retracted position.

11. The combination of claim 10 wherein the carriage power means is an electrically actuated drive motor operable by the electric control means substantially simultaneously with activation of the stop means to said retracted position.

12. The combination of claim 6 wherein the electrically actuated feed means includes suction cup means for moving backing boards one at a time out of the hopper means, and an electrically driven vaccum pump on the frame communicating with the suction cup means.

13. The combination of claim 6 including a vertically adjustable support for the frame for adjusting the outfeed end thereof to the operating level of the stacking station of the printing press, the vertically adjustable support comprising:

(a) a hollow housing having four peripherally spaced leg guides each arranged to guide an elongated support leg for vertical movement, an elongated support leg movable in each leg guide, each leg having a threaded intermediate portion, and a sprocket on each leg having a threaded hub engaging the threaded portion of the leg, the sprocket being positioned under the associated leg guide for abutment by the latter, whereby the housing is supported adjustably by the legs, an endless drive chain engaging the sprockets on the legs, and a drive sprocket on the housing engaging the drive chain for rotating the leg sprockets simultaneously.

14. The combination of claim 13 including wheels on the bottom ends of the legs.

15. In combination with a printing press having electrically actuated blank paper infeed means for delivering blank paper sheets one at a time to a printing station, electrically actuated printed paper outfeed means for delivering printed paper sheets one at a time to an outfeed stacking station, and paper sheet counter means capable of providing an electric output signal after reaching selected count values, apparatus for incorporating backing boards at spaced intervals in a stack of printed paper sheets at the outfeed stacking station of the printing press, comprising:

(a) a frame having an outfeed end positioned closely adjacent the stacking station of the printing press, (b) backing board hopper means on the frame for storing a stack of backing boards, (c) electrically actuated feed means on the frame for delivering backing boards from the hopper means one at a time through the outfeed end of the frame to the outfeed stacking station of the printing press, and (d) electric control means connected to the electrically actuated feed means and to one of the electrically actuated blank paper infeed and printed paper outfeed means and operable by an electric output signal from the counter means to deactivate said one of the electrically actuated paper infeed and outfeed means and activate said backing board feed means for a time sufficient to feed a backing board to the stack while the delivery of printed paper sheets to the stack is stopped.

16. The combination of claim 15 wherein the electric control means is connected to the electrically actuated paper infeed means and is operable by electric output signal from the counter means to stop the feeding of blank paper sheets to the printing station.

17. The combination of claim 15 including an adjustable paper stop member on the frame operable in one position of adjustment to prevent printed paper sheets being deposited at the stacking station from entering the outfeed end of the frame and in another position of adjustment to permit passage of a backing board outward through said outfeed end of the frame onto the stacking station.

18. The combination of claim 17 including electrically actuated drive means for the paper stop member and operable by the electric control means to adjust the paper stop member to said another position substantially simultaneously with activation of the backing baord feed means.

19. The combination of claim 15 including cutting line support means on the frame, and cutting line feed means on the frame operable to deposit a length of cutting line transversely across the uppermost sheet on the stack at the stacking station.

20. The combination of claim 19 wherein the cutting line feed means comprises a cutting line guide extending forwardly of the outfeed end of the frame for depositing cutting line on the stack, a cutting line guide carriage mounted on the frame for reciprocative traversal thereof, and power means engaging the carriage for reciprocating the latter.

21. The combination of claim 20 wherein the carriage power means is an electrically actuated drive motor operable by the electric control means substantially simultaneously with activation of the backing board feed means.

22. The combination of claim 15 including:

(a) an adjustable paper stop member on the frame operable in one position of adjustment to prevent printed paper sheets being deposited at the stacking station from entering the outfeed end of the frame and in another position of the adjustment to permit passage of a backing board outward through said outfeed end of the frame onto the stacking station, (b) electrically actuated drive means for the paper stop member and operable by the electric control means to adjust the paper stop member to said another position substantially simultaneously with activation of the backing board feed means, (c) cutting line support means on the frame, and cutting line feed means on the frame operable to deposit a length of cutting line transversely across the uppermost sheet on the stack at the stacking station, the cutting line feed means comprising a cutting line guide extending forwardly of the outfeed end of the frame for depositing cutting line on the stack, a cutting line guide carriage mounted on the frame for reciprocative traversal thereof, and an electric motor engaging the carriage for reciprocating the latter, (d) the electric motor being operable by the electric control means to reciprocate the cutting line guide carriage substantially simultaneously with activation of the stop means to said retracted position.

23. The combination of claim 15 wherein the electrically actuated feed means includes suction cup means for moving backing boards one at a time out of the hopper means, and an electrically driven vacuum pump on the frame communicating with the suction cup means.

24. The combination of claim 15 including a vertically adjustable support for the frame for adjusting the outfeed end thereof to the operating level of the stacking station of the printing press, the vertically adjustable support comprising:

(a) a hollow housing having four peripherally spaced leg guides each arranged to guide an elongated support leg for vertical movement, an elongated support leg movable in each leg guide, each leg having a threaded intermediate portion, and a sprocket on each leg having a threaded hub engaging the threaded portion of the leg, the sprocket being positioned under the associated leg guide for abutment by the latter, whereby the housing is supported adjustably by the legs, an endless drive chain engaging the sprockets on the legs, and a drive sprocket on the housing engaging the drive chain for rotating the leg sprockets simultaneously.

25. The combination of claim 24 including wheels on the bottom ends of at least two of the legs.

26. In combination with a printing press having an electrically actuated printed paper outfeed means for delivering printed paper sheets one at a time to an outfeed stacking station and apparatus for incorporating backing boards at spaced intervals in a stack of printed paper sheets at the outfeed stacking station, wherein said apparatus includes a frame having an outfeed end positioned closely adjacent the stacking station of the printing press, a vertically adjustable support for said frame for adjusting the outfeed end thereof to the operating level of the stacking station of the printing press, the vertically adjustable support comprising:

(a) a hollow housing having four peripherally spaced leg guides each arranged to guide an elongated support leg for vertical movement, an elongated support leg movable in each leg guide, each leg having a threaded intermediate portion, and a sprocket on each leg having a threaded hub engaging the threaded portion of the leg, the sprocket being positioned under the associated leg guide for abutment by the latter, whereby the housing is supported adjustably by the legs, an endless drive chain engaging the sprockets on the legs, and a drive sprocket on the housing engaging the drive chain for rotating the leg sprockets simultaneously.

27. The combination of claim 26 including wheels on the bottom ends of at least two of the legs.

28. The method of incorporating a plurality of backing boards into a stack of printed paper sheets as the stack is formed at the outfeed end of a printing press, wherein the printing press delivers blank paper sheets one at a time to a printing station and then the printed paper sheets are delivered one at a time from the printing station to a stacking station at the outfeed end of the press to form a stack, and wherein the printing press has an electrical counter which counts the printed paper sheets as they are delivered to the stacking station of the printing press, and wherein the backing boards are delivered to the stack one at a time from the outfeed end of a board inserter, the method comprising placing a barrier at the outfeed end of the board inserter to prevent printed sheets from the printing press from entering the outfeed end of the board inserter during delivery of printed sheets to the stack at the stacking station, and then after the last sheet of each group of predetermined number of sheets has been deposited at the stacking station simultaneously removing said barrier and after a predetermined number of counted printed paper sheets has been delivered to the stack utilizing the electrical counter to effect stopping the delivery of a next succeeding paper sheet to the stack momentarily while a backing board is delivered from the outfeed end of the board inserter to the stack at the stacking station of the printing press.

29. The method of incorporating a plurality of backing boards into a stack of printed paper sheets as the stack is formed at the outfeed end of a printing press, wherein the printing press delivers blank paper sheets one at a time to a printing station and then the printed paper sheets are delivered one at a time from the printing station to a stacking station at the outfeed end of the press to form a stack, and wherein the backing boards are delivered to the stack one at a time from the outfeed end of a board inserter, the method comprising placing a barrier at the outfeed end of the board inserter to prevent printed sheets from the printing press from entering the outfeed end of the board inserter during delivery of printed sheets to the stack at the stacking station, and then after the last sheet of each group of a predetermined number of sheets has been deposited at the stacking station simultaneously removing said barrier and stopping the delivery of a next succeeding paper sheet to the stack momentarily while a backing board is delivered from the outfeed end of the board inserter to the stack at the stacking station of the printing press, depositing a cutting line transversely across the uppermost printed paper sheet in the stack, depositing a backing board over the cutting line, depositing additional sheets of printed paper over the backing board, repeating the depositing steps to form a stack of printed paper sheets with interposed cutting lines and backing boards, applying a coating of adhesive over one edge of the stack to bond the printed paper sheets and backing boards together, and then pulling the cutting lines outwardly through the adhesive coating to sever the stack into a plurality of pads each having a reinforcing backing board.

30. The method of incorporating a plurality of backing boards into a stack of printed paper sheets as the stack is formed at the outfeed end of a printing press, wherein the printing press delivers blank paper sheets one at a time to a printing station and then the printed paper sheets are delivered one at a time from the printing station to a stacking station at the outfeed end of the press to form a stack, and wherein the backing boards are delivered to the stack one at a time from the outfeed end of a board inserter, the method comprising placing a barrier at the outfeed end of the board inserter to prevent printed sheets from the printing press from entering the outfeed end of the board inserter during delivery of printed sheets to the stack at the stacking station, and then after the last sheet of each group of a predetermined number of sheets has been deposited at the stacking station simultaneously removing said barrier and momentarily interrupting the gravity fall of a next succeeding paper sheet to the stack while a backing board is delivered from the outfeed end of the board inserter to the stack at the stacking station of the printing press.

31. The method of incorporating a plurality of backing boards into a stack of printed paper sheets as the stack is formed at the outfeed end of a printing press, wherein the printing press delivers blank paper sheets one at a time to a printing station and then the printed paper sheets are delivered one at a time from the printing station to a stacking station at the outfeed end of the press to form a stack, and wherein the backing boards are delivered to the stack one at a time from the outfeed end of a board inserter, the method comprising placing a barrier at the outfeed end of the board inserter to prevent printed sheets from the printing press from entering the outfeed end of the board inserter during delivery of printed sheets to the stack at the stacking station, and then after the last sheet of each group of a predetermined number of sheets has been deposited at the stacking station simultaneously removing said barrier and extending an arm into the ath of gravity fall of the printed paper sheet toward the stack for stopping the delivery of a next succeeding paper sheet to the stack momentarily while a backing board is delivered from the outfeed end of the board inserter to the stack at the stacking station of the printing press.

* * * * *

UNITED STATES PATENT AND TRADEMARK OFFICE

CERTIFICATE OF CORRECTION

PATENT NO. : 4,948,111

DATED : 14 August 1990

INVENTOR(S) : Elmer R. Thomsen

It is certified that error appears in the above-identified patent and that said Letters Patent is hereby corrected as shown below:

Column 11, lines 21 and 22 should read:

--press to form a stack, and wherein the backing boards are delivered to the stack from the opposite direction--.

Signed and Sealed this

Twenty-fourth Day of September, 1991

*Attest:*

HARRY F. MANBECK, JR.

*Attesting Officer*

*Commissioner of Patents and Trademarks*